US005271711A

United States Patent [19]

McGreehan et al.

[11] Patent Number: 5,271,711

[45] Date of Patent: Dec. 21, 1993

[54] COMPRESSOR BORE COOLING MANIFOLD

[75] Inventors: William F.. McGreehan; Sunil K. Mishra, both of West Chester, Ohio

[73] Assignee: General Electric Company, Cincinnati, Ohio

[21] Appl. No.: 880,826

[22] Filed: May 11, 1992

[51] Int. Cl.[5] ..... F03B 11/02

[52] U.S. Cl. ..... 415/115; 415/116

[58] Field of Search ..... 415/114, 115, 116, 117

[56] References Cited

U.S. PATENT DOCUMENTS

| | | | |
|---|---|---|---|
| 3,647,313 | 3/1972 | Koff | 415/115 |
| 4,184,797 | 1/1980 | Anderson et al. | 416/95 |
| 4,190,398 | 2/1980 | Corsmeier et al. | 415/114 |
| 4,719,747 | 1/1988 | Willkop et al. | 415/115 |
| 4,880,354 | 11/1989 | Teranishi et al. | 416/95 |
| 4,893,984 | 1/1990 | Davison et al. | 415/48 |
| 5,054,996 | 10/1991 | Carreno | 415/115 |

FOREIGN PATENT DOCUMENTS

| | | | |
|---|---|---|---|
| 0167556 | 7/1950 | Austria | 415/114 |
| 0852784 | 11/1960 | United Kingdom | 415/114 |

*Primary Examiner*—Edward K. Look
*Assistant Examiner*—Mark Sgantzos
*Attorney, Agent, or Firm*—Jerome C. Squillaro

[57] ABSTRACT

To control disc temperature, provide blade tip clearance control, and purge the rotor bore of a high pressure compressor in a gas turbine engine, an axially elongated manifold is disposed coaxially in the rotor bore to distribute cooling air bleed from the compressor inlet airstream to selected cavities between successive rotor discs in amounts tailored to the particular cooling needs of the neighboring discs.

10 Claims, 1 Drawing Sheet

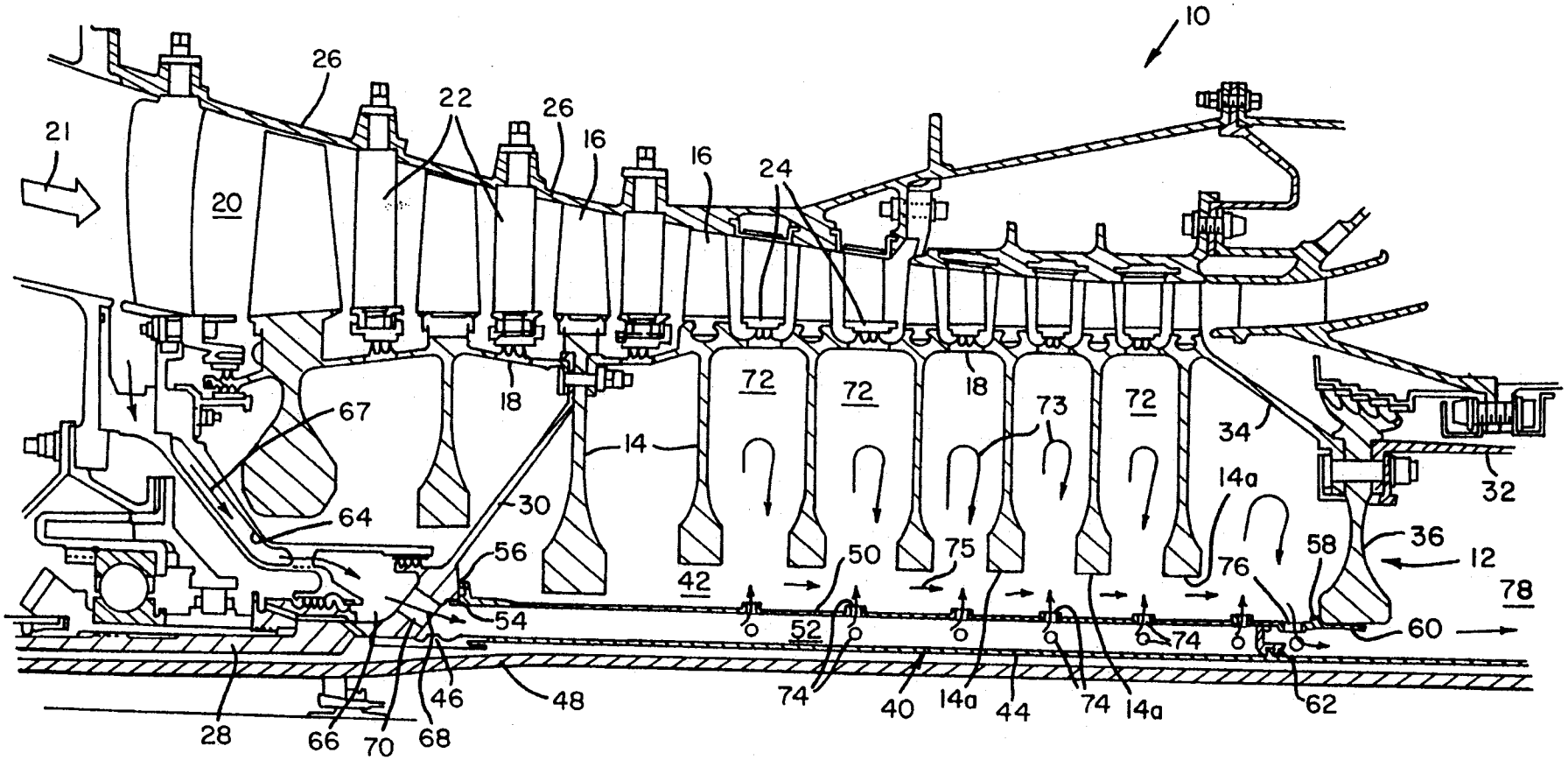
10
12
14
14a
16
18
20
21
22
24
26
28
30
32
34
36
40
42
44
46
48
50
52
54
56
58
60
62
64
66
67
68
70
72
73
74
75
76
78

COMPRESSOR BORE COOLING MANIFOLD

The present invention relates generally to gas turbine engines and particularly to controlling the temperature of the high pressure compressor rotor in a gas turbine engine.

BACKGROUND OF THE INVENTION

It is common practice to extract air from the high pressure compressor flowpath either at the inlet or a subsequent compressor stage for introduction into the compressor bore to control the temperature of the compressor rotor. The objectives of this practice are to prevent localized heating and thus extend service life, to control the clearance between the rotor blade tips and the stator shrouds defining the outer bounds of the compressor flowpath, and to purge the rotor bore. Purging is required to reduce cavity windage and to remove high temperature air leaking into the compressor bore from the compressor flowpath. Typically, the extracted cooling air is metered into the upstream or forward end of the compressor bore, which then flows monotonically downstream through the bore, with mixing of the cooling air and the air existing in the cavities between rotor discs determined mainly by local flow conditions. Because the various compressor stage discs have different cooling requirements, the monotonic flow of extracted air through the compressor bore from forward to aft ends does not fully achieve these objectives.

SUMMARY OF THE INVENTION

It is accordingly a principal objective of the present invention to provide the ability to distribute cooling air differentially throughout the axial length of a compressor bore so as to more fully satisfy the particular thermal requirements of individual disc stages of a rotor in a gas turbine engine.

To this end and in accordance with the present invention, inner and outer coaxially spaced tubes are concentrically mounted in the compressor bore to provide an axially elongated, annular manifold chamber. Cooling air is bleed from the airstream entering the compressor annular flowpath and directed into the open forward end of the manifold cavity. A set of circumferentially spaced orifices are provided in the outer tube at each of a plurality of predetermined axial locations to inject cooling air radially into selected cavities between the discs of adjacent stages, which project into the compressor bore.

The number and size of the orifices at each axial location are selected to satisfy the peculiar cooling needs of each stage. The cooling air distributed to the selected inter-disc cavities mixes with air existing therein to promote both cooling of the adjacent discs and purging of the compressor bore. The purging air exits the compressor bore through exhaust ports in the outer tube beyond the manifold chamber. At those axial locations where mixing is not required, cooling air orifices are omitted. By virtue of this controlled distribution of cooling air into the compressor bore, improved control of disc temperature on a selective, stage-by-stage basis is achieved with consequent elimination of hot spots and improvements in blade tip clearance control.

The invention accordingly comprises the features of construction, combination of elements and arrangement of parts, all as detailed hereinafter, and the scope of the invention will be indicated in the claims.

BRIEF DESCRIPTION OF THE DRAWING

For a full understanding of the nature and objective of the present invention, reference may be had to the following Detailed Description taken in conjunction with the accompanying drawing, in which the sole figure is an axial sectional view of a high pressure compressor incorporating a bore cooling manifold constructed in accordance with the present invention.

DETAILED DESCRIPTION

As seen in the drawing, a high pressure compressor, generally indicated at 10, includes a rotor generally indicated at 12 and comprised of successive stages of rotor discs 14, each mounting at their periphery an annular array or row of angularly spaced blades 16. The disc stages are joined together adjacent their peripheries by intervening, annular spacers 18 which define the inner bounds of an annular flowpath 20 through the compressor for an airstream indicated by arrow 21. An annular row of stator vanes 22, mounted by the compressor casing, project radially inwardly into the flowpath between each consecutive stage of blades and terminate proximate annular labyrinth seals 24 carried by spacers 18. The spaces between consecutive rows of vanes are closed by annular shrouds 26 which also serve to define the outer bounds of the annular flowpath through the compressor. As is well understood in the art, it is important to maintain minimal clearances between the tips of blades 16 and shrouds 26 over the full range of engine operating conditions despite variations in radial growth of the rotor due to centrifugal loading and differential thermal growths of stator and rotor elements with variations in temperature.

The joined rotor disc stages are mounted at a forward or upstream end to a hollow shaft 28 by an integral conical flange 30 and at an aft or downstream end to a hollow shaft 32 by a conical flange 34 and an intervening disc 36. Shaft 32 is drivingly connected to the rotor of a high pressure turbine (not shown).

In accordance with the present invention, a cooling manifold, generally indicated at 40, is disposed concentrically within the bore 42 of compressor rotor 12. This manifold comprises an inner tube 44 whose forward edge is welded to a sleeve 46 carried in slip-fit engagement with shaft 28 at its junction with flange 30. The aft end of the inner tube is suitably connected to the high pressure turbine rotor (not shown). The inner manifold tube is thus mounted in coaxial relation about a hollow shaft 48 connecting the fan and low pressure compressor (not shown) located upstream of high pressure compressor 10 to the low pressure turbine (not shown) located immediately aft of the high pressure turbine in a conventional turbofan gas turbine engine configuration.

Manifold 40 also includes an outer tube 50 disposed in coaxial, spaced relation to inner tube 40 to provide an axially elongated, annular manifold chamber 52. To mount the outer tube, its forward end is configured to provide an annular ledge 54 which engages in slip-fit fashion an annular ridge 56 formed on conical flange 30. The aft end of the outer tube is formed having a radially outstanding shoulder 58 and a convergent marginal end portion 60 for slip-fit engagement in the bore of aft-most rotor disc 36. Located between the inner and outer tubes forwardly of the aft end of the outer tube is an annular seal 62 establishing the aft end of manifold chamber 52.

During engine operation, a predetermined amount of cooling air from the compressor inlet airstream 21 is bleed off through one or more channels 64 into an annular cavity 66 (arrows 67). From this cavity, cooling air flows, as indicated by arrow 68, through an annular array of slots 70 into the upstream end of manifold chamber 52. At axial locations generally radially aligned with selected cavities 72 defined between adjacent stages of rotor discs 14 projecting into rotor bore 42, the outer manifold tube is provided with at least one and preferably a plurality of circumferentially spaced orifices 74, wherein orifices 74 are utilized to inject cooling air from manifold chamber 52 into rotor bore 42. By virtue of the axial locations of the orifices and the pressure drops across the orifices, the injected cooling air establishes a circulating pattern (arrows 73) in the radially aligned inter-disc cavities 72 effective in producing forced mixing of cooling air with heated air existing in these cavities. Since manifold 40 rotates with compressor rotor 12, the injected cooling air possesses an angular velocity component which produces a swirling action to further promote mixing. The circulating air flow purges the inter-disc cavities of stagnant hot air and high temperature air leaking in from flowpath 20, and improves convection cooling of rotor discs 14. From the inter-disc cavities, the cooling air-hot air mixture flows (arrows 75) rearwardly through the disc bores 14*a* toward disc 36 closing off the aft end of compressor bore 42. The air mixture then exhausts through ports 76 in outer manifold tube located just aft of manifold chamber seal 62 and out into the high pressure turbine bore area 78. A continuous flow of air through compressor bore 42 is established to control rotor disc temperature and to purge the compressor bore.

It will be appreciated that the axial locations of the sets of orifices 74 are selected to distribute cooling air to the inter-disc cavities on essentially a stage-by-stage basis depending on need. The degree of cooling of rotor discs neighboring these cavities can then be tailored to its particular requirements by varying the orifice size and/or number of orifices. For those inter-disc cavities that do not require injected cooling air-cavity air mixing, manifold orifices are omitted. In this way, rotor disc temperatures can be selectively regulated for blade tip clearance control purposes.

While utilization of bleed air from the compressor inlet airstream 21 is specifically disclosed herein, it will be appreciated that bleed air can be extracted from a downstream, higher pressure/temperature compressor stage, such as disclosed in commonly assigned U.S. Pat. No. 4,893,983, or extracted and mixed from several compressor stages to obtain a desired bleed air temperature. Moreover, valves may be utilized to accommodate adjustable control of bleed air flow and temperature. It will also be appreciated that bleed air may be introduced into the manifold cavity at locations other than its forward end.

In view of the foregoing, it is seen that the objectives set forth, including those made apparent from the Detailed Description, are efficiently attained, and, since certain changes may be made in the construction set forth, it is intended that matters of detail be taken as illustrative and not in a limiting sense.

Having described the invention, what is claimed as new and desired to secure by Letters Patent is:

1. In a gas turbine engine rotor having a bore into which stages of discs radially project to define a succession of inter-disc cavities, a manifold comprising, in combination:

A. an elongated inner tube mounted coaxially within the rotor bore;

B. an elongated outer tube mounted in coaxially spaced relation with said inner tube to define an axially elongated, annular manifold chamber into which bleed air is introduced, wherein said manifold chamber is positioned radially inward of said stages of discs;

C. plural orifices provided in said outer tube at predetermined axially spaced locations, wherein each of said plural orifices are positioned axially between a pair of adjacent ones of said stages of discs such that said predetermined axially spaced locations are respectively radially aligned with different ones of said inter-disc cavities, wherein said plural orifices inject bleed air from said manifold chamber into selected inter-disc cavities to mix with air therein and to control the temperature of neighboring discs, wherein said predetermined axially spaced locations of said plural orifices are effective in producing forced mixing of the bleed air and the air located within the selected inter-disc cavities.

2. In a gas turbine engine rotor having a bore into which stages of discs radially project to define a succession of inter-disc cavities, a manifold comprising, in combination:

A. an elongate inner tube mounted coaxially within the rotor bore;

B. an elongated outer tube mounted in coaxially spaced relation with said inner tube to define an axially elongated, annular manifold chamber into which bleed air is introduced;

C. plural orifices provided in said outer tube at predetermined axially spaced locations for injecting bleed air from said manifold chamber into selected inter-disc cavities to mix with air therein and to control the temperature of neighboring discs; and D. an annular seal disposed between said inner and outer tubes to close off an end of said manifold cavity, and a port provided in said outer tube at an axial location beyond said seal to exhaust air from the rotor bore.

3. The manifold defined in claim 2, wherein a plurality of circumferentially spaced said orifices are provided at each said axial location.

4. The manifold defined in claim 3, wherein a plurality of circumferentially spaced said exhaust ports are provided in said outer tube.

5. The manifold defined in claim 3, wherein at least said outer tube is mounted for rotation with the rotor.

6. The manifold defined in claim 3, wherein the rotor is a compressor rotor, and each of the stages of discs supports a row of angularly spaced blades projecting into a flowpath for an airstream flowing through a compressor, and wherein bleed air tapped form the airstream at the compressor inlet is introduced into an end of said manifold chamber axially spaced in an upstream direction from said seal, said exhaust port axial location in said outer tube being downstream from said seal.

7. The manifold defined in claim 6, wherein said orifice axial locations are respectively radially aligned with different ones of said inter-disc cavities.

8. The manifold defined in claim 7, wherein the size and number of said orifices at each said axial location are selected to meet the cooling needs of those disc neighboring each inter-disc cavity.

9. The manifold defined in claim 8, wherein at least said outer tube is mounted for rotation with the rotor.

10. The manifold defined in claim 9, wherein the ends of said outer tube are configured for slip-fit engagement with the rotor.

* * * * *